US010040627B2

(12) United States Patent
Cooper et al.

(10) Patent No.: US 10,040,627 B2
(45) Date of Patent: Aug. 7, 2018

(54) REFUSE VEHICLE MECHANISM FOR PROHIBITING OPERATION OF A DEVICE ON THE VEHICLE

(71) Applicant: The Heil Co., Chattanooga, TN (US)

(72) Inventors: Matthew B. Cooper, Madison, AL (US); John W. Bedwell, Southside, AL (US)

(73) Assignee: The Heil Co., Chattanooga, TN (US)

( * ) Notice: Subject to any disclaimer, the term of this patent is extended or adjusted under 35 U.S.C. 154(b) by 337 days.

(21) Appl. No.: 14/687,178

(22) Filed: Apr. 15, 2015

(65) Prior Publication Data

US 2015/0298905 A1 Oct. 22, 2015

Related U.S. Application Data

(60) Provisional application No. 61/980,761, filed on Apr. 17, 2014.

(51) Int. Cl.

| | |
|---|---|
| ***E01H 5/00*** | (2006.01) |
| ***B65F 3/00*** | (2006.01) |
| ***E01H 5/06*** | (2006.01) |

(52) U.S. Cl.

CPC ..... *B65F 3/00* (2013.01); *E01H 5/061* (2013.01)

(58) Field of Classification Search

CPC ..... B65F 3/00; B65F 2003/0216; B65F 2210/182; E01H 5/00; E01H 5/04; E01H 5/06; E01H 5/061

USPC ..... 460/23

See application file for complete search history.

(56) References Cited

U.S. PATENT DOCUMENTS

| | | | | | |
|---|---|---|---|---|---|
| 3,246,313 | A * | 4/1966 | Weaklend | A01D 41/1208 | 200/61.2 |
| 3,327,659 | A * | 6/1967 | Nolan | F23G 5/40 | 110/185 |
| 3,733,818 | A | 5/1973 | Veres | | |
| 3,908,206 | A * | 9/1975 | Grewing | E04H 4/12 | 137/426 |
| 4,586,532 | A * | 5/1986 | Tsolkas | F16K 31/24 | 119/79 |
| 4,686,718 | A * | 8/1987 | Kinkead | E04H 4/1209 | 137/428 |
| 4,735,230 | A * | 4/1988 | Detloff | E03D 1/00 | 137/15.26 |
| 4,807,375 | A | 2/1989 | Iraci | | |
| 5,601,240 | A * | 2/1997 | Merklinger | B02C 21/02 | 241/101.74 |
| 5,816,766 | A * | 10/1998 | Clark | B60P 1/26 | 298/23 M |
| 5,832,637 | A | 11/1998 | Aguado et al. | | |
| 5,901,476 | A | 5/1999 | Buonfiglio | | |
| 6,006,605 | A * | 12/1999 | Sulollari | G01F 23/36 | 73/306 |

(Continued)

*Primary Examiner* — Thomas B Will
*Assistant Examiner* — Joan D Misa
(74) *Attorney, Agent, or Firm* — Fish & Richardson P.C.

(57) ABSTRACT

A refuse vehicle has a mechanism to prohibit operation of a snow plow attached to the refuse vehicle. A sensor associated with the storage bin of the refuse vehicle. The sensor sends a signal to a controller to prohibit operation of the snow plow in response to the storage bin payload. The mechanism prohibits lowering of the snow plow in a condition when the payload in the storage bin is such that the load on the front axle of the refuse vehicle would exceed legal limits.

12 Claims, 4 Drawing Sheets

(56) References Cited

U.S. PATENT DOCUMENTS

| | | | |
|---|---|---|---|
| 6,163,985 | A | 12/2000 | Chinnery et al. |
| 6,253,470 | B1 | 7/2001 | Depies et al. |
| 7,185,449 | B2 | 3/2007 | Kime |
| 7,431,101 | B2 | 10/2008 | Hacker |
| 7,561,034 | B2 | 7/2009 | Reichow et al. |
| 8,019,515 | B2 | 9/2011 | Okeson et al. |
| 8,068,961 | B2 | 11/2011 | Menze |
| 8,185,276 | B2 | 5/2012 | Buckbee et al. |
| 8,375,607 | B2 | 2/2013 | Menze |
| 8,764,371 | B2 | 7/2014 | Whitfield, Jr. et al. |
| 2006/0045700 | A1 | 3/2006 | Siebers et al. |
| 2014/0328656 | A1 | 11/2014 | Whitfield, Jr. et al. |
| 2015/0105974 | A1 | 4/2015 | Kleve et al. |

* cited by examiner

REFUSE VEHICLE MECHANISM FOR PROHIBITING OPERATION OF A DEVICE ON THE VEHICLE

CROSS-REFERENCE TO RELATED APPLICATIONS

This application claims the benefit of U.S. Provisional Application No. 61/980,761, filed on Apr. 17, 2014. The entire disclosure of the above application is incorporated herein by reference.

FIELD

The present disclosure relates to refuse vehicles and, more particularly, to a mechanism to prohibit operation of a device on the vehicle, such as a snow plow.

BACKGROUND

In various cities in the United States that experience snow, the snow must be plowed to remove it from the streets. In cities where the city owns various types of vehicles, it is desirable to optimize their use. In cities, such as New York City, where the city owns numerous refuse vehicles, it would be desirous to utilize these vehicles for other purposes. Accordingly, these cities have modified its refuse vehicles to include snow plows on the front of the vehicles in order to plow snow with the vehicles. Thus, the refuse vehicles serve a dual purpose and enable the city to optimize its vehicles while reducing costs.

However, when placing a snow plow on the front of the refuse vehicle, when the refuse vehicle storage bin is loaded, it causes a substantial amount of weight to be placed on the front axle of the refuse vehicle. With the amount of weight centered on the front axle of the vehicle, it is not uncommon for the refuse vehicle to exceed the legal loading limit on the front axle. Thus, due to the numerous bridges and roads in the city, the refuse vehicle is unable to travel on these particular roads. Thus, it would be desirable to have a mechanism that is able to signal the operator that the storage bin or container has a payload so that the plow cannot be lowered. Accordingly, the operator must empty the storage bin or container so that the snow plow can be lowered. The refuse vehicle can then be utilized to plow snow.

Accordingly, the present disclosure provides the art with a mechanism capable of prohibiting the snow plow device from being lowered to plow snow when the weight on the front axle would exceed legal limits. The present disclosure signals an operator to empty the storage bin or container in order to enable lowering of the plow for snow removal. The present disclosure provides a simple device maintained in the storage bin that prohibits lowering of the snow plow.

SUMMARY

Accordingly to a first aspect of the disclosure, a mechanism to prohibit operation of a device comprises a sensor. The sensor sends a signal to a controller to prohibit operation of the device. A flag mechanism is sensed by the sensor. The flag mechanism moves in response to an amount of refuse in a storage bin or container of a refuse collection vehicle. Based upon the amount of refuse or payload in the storage bin or container, the sensor sends a signal to a controller prohibiting operation of the device. The flag mechanism further includes an adjustable pole coupled with a link that is secured to a clamping member. The clamping member is coupled with a telescopic cylinder associated with a ram in the storage bin or container. Movement of the telescopic cylinder moves the flag mechanism into a position where it can be sensed by the sensor.

According to a second aspect of the disclosure, a mechanism for a refuse vehicle to prohibit operation of a snow plow attached to the refuse vehicle comprises a sensor. The sensor sends a signal to a controller to prohibit operation of the snow plow. A flag mechanism is sensed by the sensor. The flag mechanism moves in response to an amount of refuse in a storage bin or container on a refuse collection vehicle. Based upon the amount of refuse in the storage bin or container, the sensor sends a signal to the controller prohibiting operation of the snow plow. The flag mechanism further includes an adjustable pole coupled with the link that is secured to a clamping member. The clamping member is coupled with a telescopic cylinder associated with the ram in the storage bin or container. Movement of the telescopic cylinder moves the flag mechanism into a position where it is sensed by the sensor.

Accordingly to a third aspect of the disclosure, a refuse vehicle comprises a mechanism to prohibit operation of a snow plow attached to the refuse vehicle. The vehicles comprise a chassis with a frame including a cab and storage bin. Wheels, via axles, are attached with the chassis. A snow plow is attached to the front of the refuse vehicle. A mechanism to prohibit operation of the snow plow comprises a sensor. The sensor sends a signal to a controller to prohibit operation of the snow plow. A flag mechanism is sensed by the sensor. The flag mechanism moves in response to an amount of refuse in the storage bin or container of the refuse collection vehicle. Based upon the amount of refuse in the storage bin or container, the sensor sends a signal to the controller prohibiting operation of the snow plow. The flag mechanism further includes an adjustable pole coupled with the link that is secured to a clamping member. The clamping member is coupled with a telescopic cylinder associated with the ram in the storage bin or container. Movement of the telescopic cylinder moves the flag mechanism into a position where it is sensed by the sensor.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
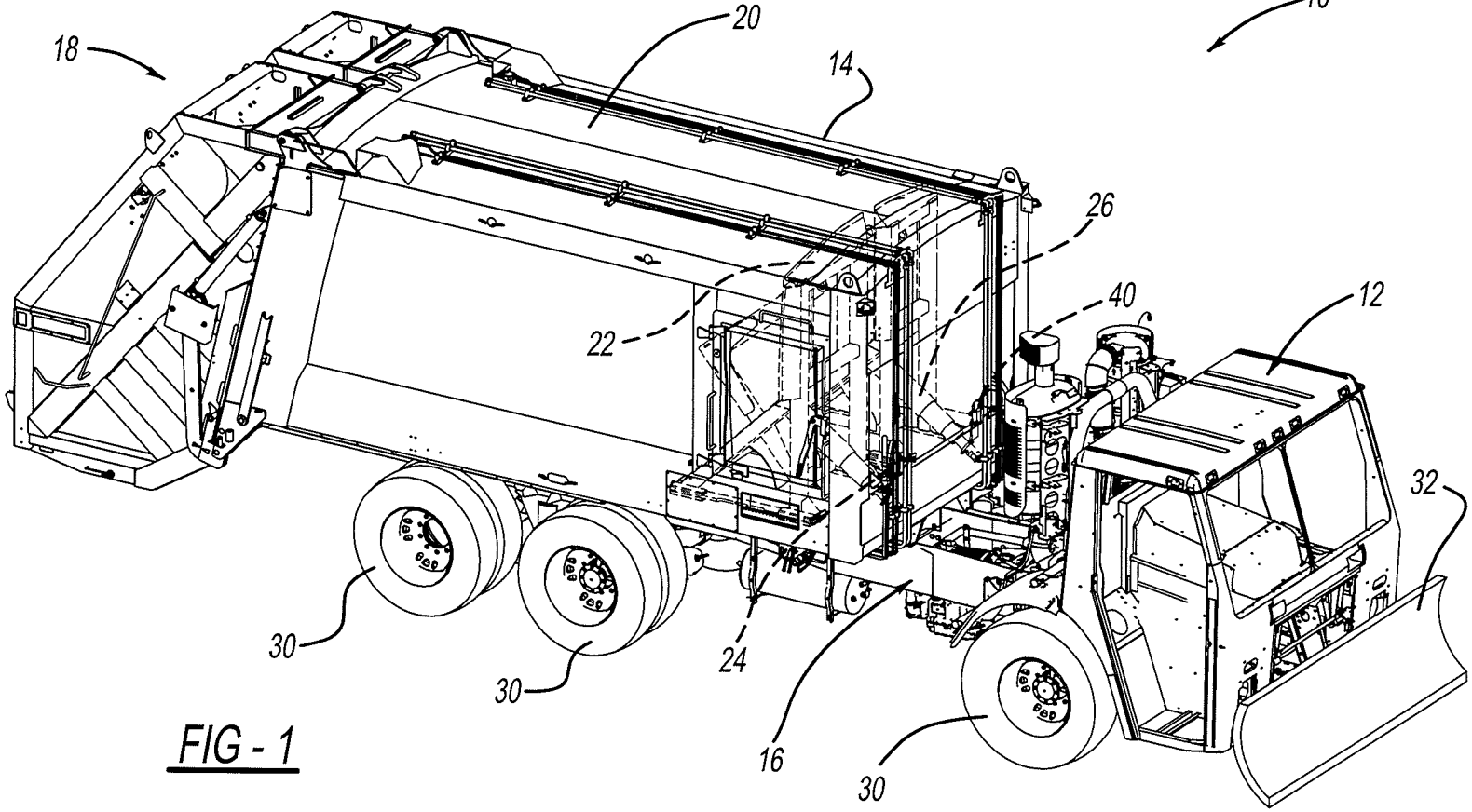
FIG. 1 is a perspective view of a refuse vehicle according to the present disclosure.
Figure 2:
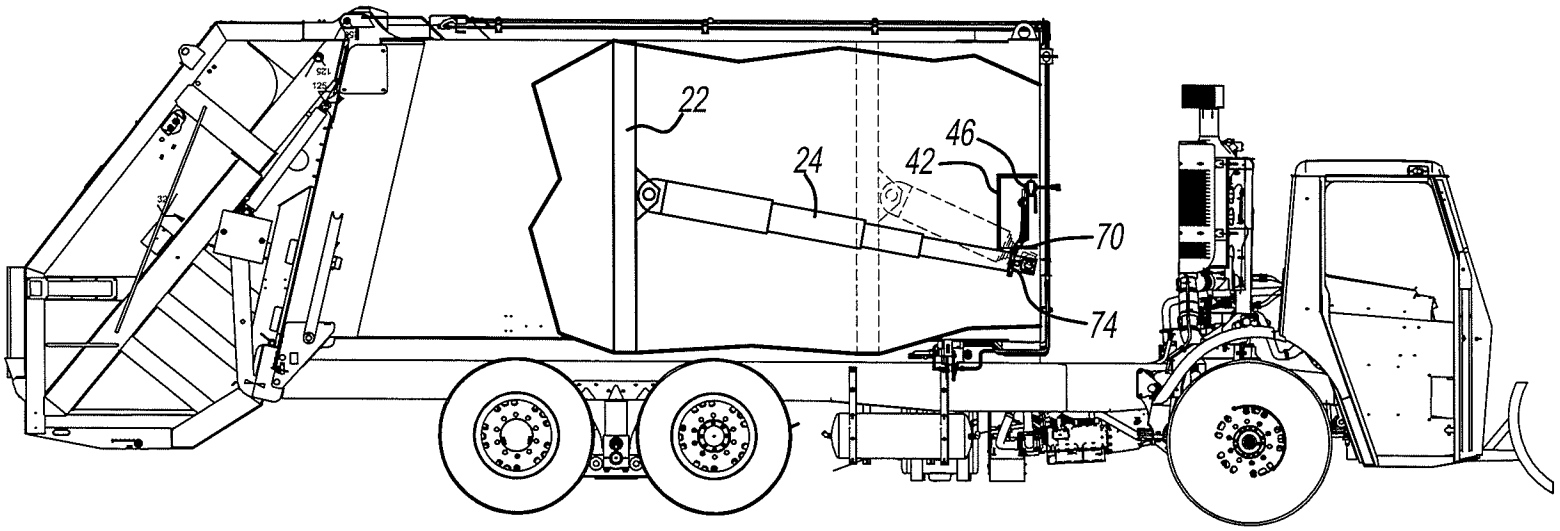
FIG. 2 is a side view of a refuse vehicle according to the present disclosure.
Figure 3:
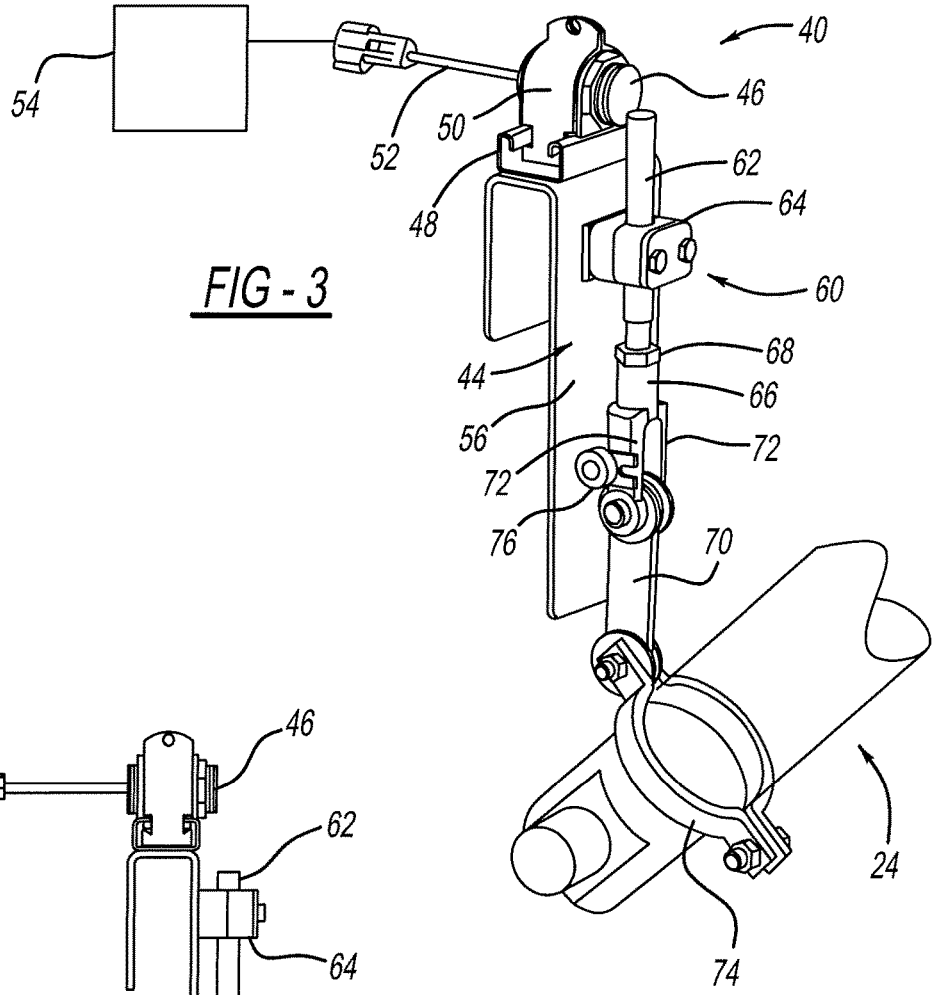
FIG. 3 is a perspective view of the mechanism to prohibit operation of the device.

Turning to the figures, a rear loading refuse collection vehicle is illustrated and designated with the reference numeral 10. The vehicle includes a cab 12 and a storage bin 14 secured to the vehicle chassis or frame 16. A rear loading hopper 18 is coupled with the storage bin 14. A ram mechanism 20 is positioned inside of the storage bin 14. The ram mechanism 20 includes a blade 22 and a telescoping cylinder 24. The telescoping cylinder 24 is pivotally retained at the front of the storage bin or container 14. The telescoping cylinder 24 includes a plurality of sections 26. Also, the vehicle 10 includes axles and wheels 30 that support the chassis on the ground. A snow plow 32 is secured to the front of refuse vehicle 10. The snow plow 32 is like those commercially available including a hydraulic kit to connect the snow plow 32 with the truck for operation.

A mechanism 40, that prohibits the operation of the snow plow 32, is positioned inside of the storage bin 14. The mechanism 40 is coupled with a controller 54 that prohibits the lowering of the snow plow 32. This occurs in the event that the storage bin 14 has a payload that would result as a force or load on the front axle of the refuse vehicle 10 that exceeds legal load limits if the snow plow 32 is lowered and used to plow snow.

In a rear loading refuse vehicle 10, the refuse enters the storage bin or container 14 from the rear of the vehicle 10. As the rear hopper 18 continues to accept refuse, the blade 22 moves toward the forward end of the storage bin 14. As this occurs, the telescopic cylinder 24 begins to collapse. As this occurs, the cylinder sections 26 move upon one another reducing the length of the telescopic cylinder 24. Additionally, as the telescopic cylinder 24 collapses upon itself, the telescopic cylinder 24 pivots with respect to a longitudinal axis of the storage bin 14 or vehicle to enable more payloads to be added to the refuse vehicle 10. In populated cities, the storage bin 14 may be split down the longitudinal axis of the vehicle so that half of the storage container includes garbage, trash or the like and the other half includes recyclables. Also, two ram systems 20 like those disclosed would be utilized on each side of the partition. Further, due to the density of the garbage or trash, as well as the recyclables, different weights may occur on different sides of the vehicle 10. These weights need to be accounted for in the event that the refuse vehicle 10 is utilized to plow snow. When the refuse vehicle is utilized as a snow plowing vehicle, the refuse vehicle 10 is not used to collect refuse. However, refuse may still be present in the vehicle 10 when the refuse vehicle 10 is required to be used as a snow plowing vehicle.

The mechanism 40, for prohibiting operation of the snow plow 32, is mounted on the wall of the storage bin 14. The mechanism 40 includes a cover 42 as well as a base 44. The base 44 is secured to the wall of the storage bin 14. The mechanism 40 includes a sensor 46 that is secured to the base 44. Here, the sensor is retained on the base 44 by brackets 48, 50. The sensor 46 also includes a lead 52 that is coupled with the controller 54. However, the sensor 46 could be wirelessly coupled with the controller. The base 44 includes a portion 56 that is a substantially planar member. The planar member 56 includes a flag mechanism 60 mounted on it. The flag mechanism 60 is sensed by the sensor 46. Flag mechanism 60 includes a pole 62 retained in a guide 64 mounted to the planar member 56. The pole 62 is threaded into a clevis 66 that enables the pole 62 to be adjusted with respect to the clevis 66. This accommodates for a variation in dimension differences in different refuse vehicles. A locking device or jam nut 68 is coupled with the clevis to lock the pole 62 in position after the pole 62 has been set. A link 70 is coupled with the clevis arms 72. The link 70 is coupled with a clamping element 74. The clamping element 74 is coupled with the telescopic cylinder 24. A roller 76 rolls along the plate portion 56 to enhance movement of the flag mechanism 60. Alternatively, the planar member could be eliminated and a wall of the storage bin could be utilized.

Figure 4:
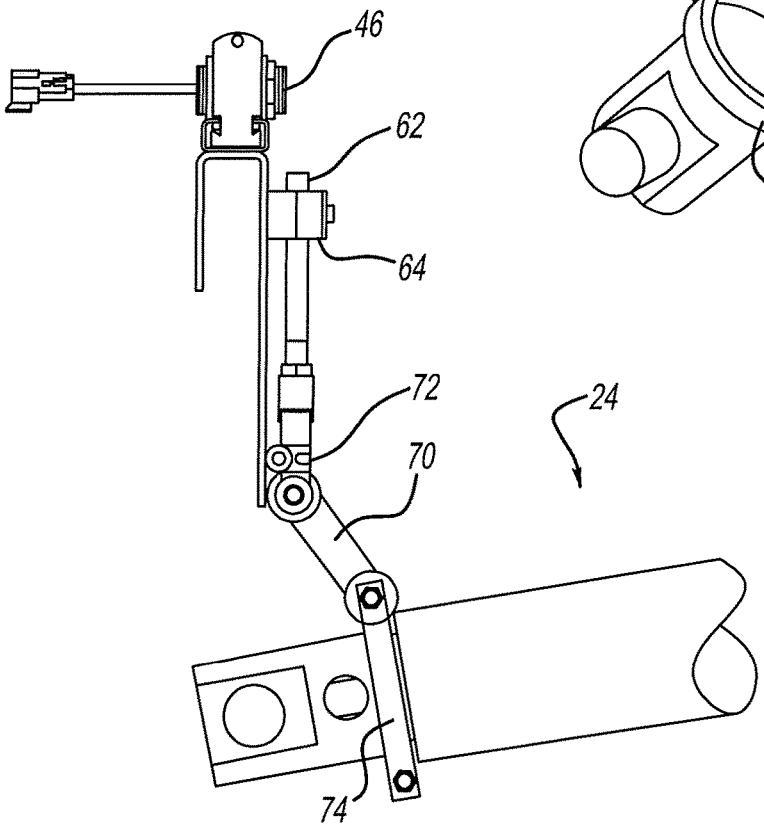
FIGS. 4-6 are side elevation views of the mechanism of FIG. 3 in various positions.
Figure 5:
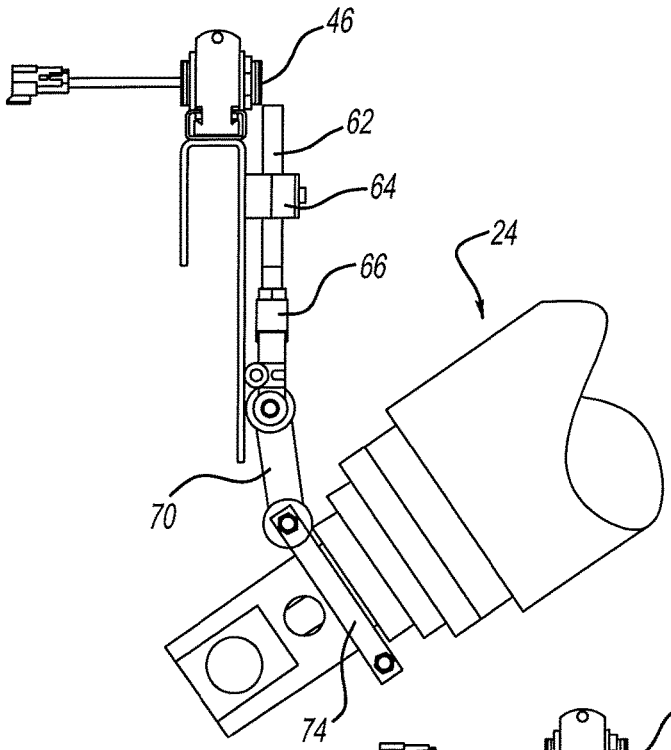
Figure 6:
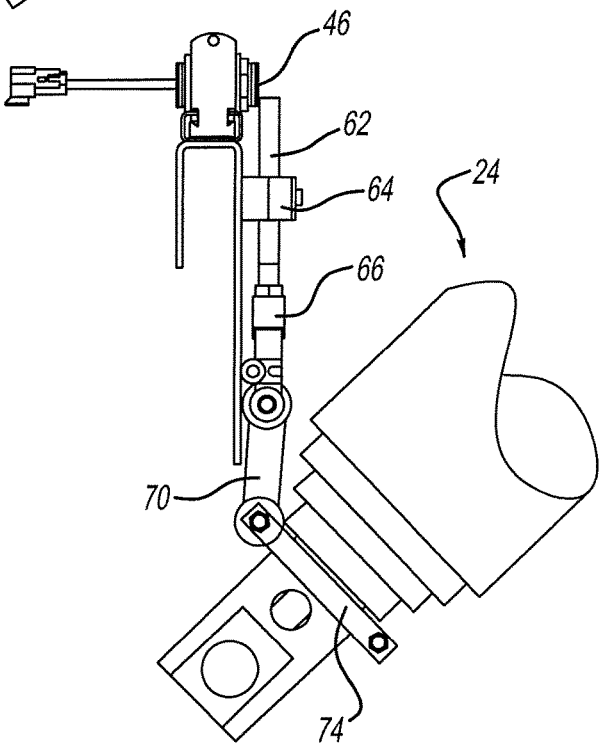

Turning to FIGS. 4-6, the operation of the mechanism will be discussed.

When the storage bin 14 is relatively empty, the cylinder 24 maintains a position closer to the longitudinal axis of the vehicle 10. This is illustrated in FIG. 4. Thus, the clamping mechanism 74 is drawn downward forcing the link 70 to be angled with respect to the clevis arms 72. Thus, the pole 62 is moved into the guide 64 with a portion of the pole extending slightly above the guide 64, as illustrated in FIG. 4. As the storage bin 14 is filled with refuse, the cylindrical telescoping cylinder 24 moves inward away from the hopper 18 and along the longitudinal axis of the vehicle. As the storage bin becomes full, the telescopic cylinder 24 tilts upward. As this occurs, due to the pivoting of the telescopic cylinder 24, the link 70 becomes more co-linear with the clevis 66 and pole 62 as illustrated in FIG. 5. Here, in FIG. 5, the pole 62 is just sensed by the sensor 46. This is an indication that the maximum load has been received by the storage bin 14 so that a load on the front axle of the vehicle will not exceed a legal load limit if the snow plow 32 is lowered into a plowing position. Since the refuse vehicle 10 is utilized, most of the time, to collect refuse, as more payload is added to the storage bin, the pole 62 continues to rise in the guide and is sensed by the sensor 46 as illustrated in FIG. 6. Here, the link 70 becomes co-linear with the clevis 66 and pole 62 as illustrated in FIG. 6. At this point, the refuse vehicle storage bin 14 has reached a maximum payload.

When the refuse vehicle 10 is used as a snow plowing vehicle, the mechanism 40 may be at any one of the positions illustrated in FIGS. 4-6. If the refuse vehicle storage bin 14 has a payload so that the pole 62 of the flag mechanism 60 is below the sensor 46, when the refuse vehicle is used as a snow plowing vehicle, the snow plow 32 will be allowed to move into a snow plowing position. Here, a signal is sent to the controller to notify the user that the snow plow 32 can be lowered and that maximum weight limits on the front axle will not be exceeded. Thus, the snow plow 32 can be lowered and the refuse vehicle 10 can be used as a snow plowing vehicle.

In the event that the flag mechanism 60 is in a position as shown in FIG. 5, where the pole 62 is just being sensed, the payload in the storage container 14 is at a level where loading on the front axle may be maintained below a legal load limit. Thus, the snow plow 32 may or may not be lowered and the refuse vehicle 10 used as a snow plowing vehicle. If the setting is such that the load on the front axle is below the legal limit, the refuse vehicle will be able to be used as a snow plowing vehicle. The snow plow 32 will be able to be lowered. In the event that the load on the front axle is at a legal limit, a signal would be sent from the controller so that the snow plow 32 would not be able to be lowered. In the event that the sensor 46 already senses the pole 62, as illustrated in FIG. 6, the controller 54 will send a signal so that the snow plow 32 cannot be lowered. Thus, refuse in the vehicle storage bin 14 must be emptied or the payload reduced in order to utilize the refuse vehicle 10 as a snow plowing vehicle. Thus, by sensing the flag mechanism 60, the controller 54 indicates that the payload must be reduced in order to utilize the refuse vehicle 10 as a snow plowing vehicle. Additionally, the controller 54 indicates that the refuse vehicle has a payload where the refuse vehicle cannot be used as a snow plowing vehicle.

The mechanism 40 for controlling the operation of the snow plow 32 can be retrofit to existing refuse vehicles or it can be present on an OEM device. The mechanism 40 provides a simple effective payload sensing device. Thus, when the refuse vehicle is utilized as a snow plowing vehicle, the load limit on the front axle is maintained under a legal loading limit.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A mechanism for prohibiting operation of a device of a refuse collection vehicle comprising:

a storage bin on the refuse collection vehicle;

a sensor, the sensor sending a signal to a controller to prohibit operation of the device; and a flag sensed by the sensor, the flag is coupled with an element moving the flag into the position to be sensed by the sensor, the element is positioned away from the refuse in the storage bin to prohibit contact of the element with the refuse, the flag moves in response to an amount of refuse in the storage bin of the refuse collection vehicle, based on the amount of refuse in the storage bin, the sensor sends a signal to the controller prohibiting operation of the device.

2. The mechanism of claim 1, wherein the flag further comprises an adjustable pole coupled with a link secured with a clamping member.

3. The mechanism of claim 2, wherein the clamping member is coupled with the element being a telescopic cylinder in the storage bin.

4. The mechanism of claim 3, wherein movement of the telescopic cylinder moves the flag into a position to be sensed by the sensor.

5. A mechanism for a refuse collection vehicle for prohibiting operation of a snow plow attached to the refuse vehicle comprising:

a storage bin on the refuse collection vehicle;

a sensor, the sensor sending a signal to a controller to prohibit operation of the snow plow; and a flag sensed by the sensor, the flag is coupled with an element moving the flag into the position to be sensed by the sensor, the element is positioned away from the refuse in the storage bin to prohibit contact of the element with the refuse, the flag moves in response to an amount of refuse in the storage bin of the refuse collection vehicle, based on the amount of refuse in the storage bin, the sensor sends a signal to the controller prohibiting operation of the snow plow.

6. The mechanism of claim 5, wherein the flag further comprises an adjustable pole coupled with a link secured with a clamping member.

7. The mechanism of claim 6, wherein the clamping member is coupled with the element being a telescopic cylinder in the storage bin.

8. The mechanism of claim 7, wherein movement of the telescopic cylinder moves the flag into a position to be sensed by the sensor.

9. A refuse vehicle comprising a mechanism for prohibiting operation of a snow plow attached to the refuse vehicle comprising:

a chassis having a frame with a cab, storage bin and wheels;

a snow plow attached to the refuse vehicle;

a sensor, the sensor sending a signal to a controller to prohibit operation of the snow plow; and a flag sensed by the sensor, the flag moving in response to an amount of refuse in the storage bin wherein based on the amount of refuse in the storage bin, the sensor sends a signal to the controller prohibiting operation of the snow plow.

10. The refuse vehicle of claim 9, wherein the flag further comprises an adjustable pole coupled with a link secured with a clamping member.

11. The refuse vehicle of claim 10, wherein the clamping member is coupled with a telescopic cylinder in the storage bin.

12. The refuse vehicle of claim 11, wherein movement of the telescopic cylinder moves the flag into a position to be sensed by the sensor.

* * * * *